United States Patent [19]

Svensson

[11] 4,250,360

[45] Feb. 10, 1981

[54] DEVICE TO AUTOMATICALLY ACTIVATE OR DEACTIVATE CONTROL MEANS

[76] Inventor: Gustav E. Svensson, Villa Solhäll, Holm, Sweden, 310 33

[21] Appl. No.: 867,018

[22] Filed: Jan. 5, 1978

[51] Int. Cl.[3] ..... F15B 13/04; H01H 35/38

[52] U.S. Cl. ..... 200/82 C; 91/47; 91/419; 137/38; 137/43; 137/526

[58] Field of Search ..... 91/419, 52, 47; 137/38, 137/43, 46, 48, 526; 200/82 C; 303/24 A; 188/136

[56] References Cited

U.S. PATENT DOCUMENTS

| | | | |
|---|---|---|---|
| 1,070,740 | 8/1913 | Sabrde | 91/52 X |
| 1,184,222 | 5/1916 | Zerbe | 137/38 X |
| 2,630,815 | 3/1953 | Worthing | 137/48 |
| 2,639,898 | 5/1953 | Booth | 200/83 Q |
| 2,938,502 | 5/1960 | Neal | 91/52 |
| 3,039,833 | 6/1962 | Farkas | 200/82 C |
| 3,242,936 | 3/1966 | Kalb | 137/48 |
| 3,302,530 | 2/1967 | Dobrikin et al. | 92/63 X |
| 3,334,545 | 8/1967 | Houser | 92/130 C |
| 3,415,021 | 12/1968 | Myers | 137/38 X |
| 3,437,010 | 4/1969 | Jacobi et al. | 91/419 X |
| 3,964,504 | 6/1976 | Inhofer | 137/38 X |
| 4,012,079 | 3/1977 | Takeshita | 303/24 A |

*Primary Examiner*—Irwin C. Cohen

[57] ABSTRACT

A device designed to effect automatic activation or deactivation of electrically, hydraulically or pneumatically operated control means, comprising a body freely movable in an air-tight housing and in its normal position sealing an aperture, a spring-biased control member arranged in a conduit one end of which is connected to the chamber and the opposite end of which is closed by said control member, which member may be displaced in said conduit between an activating and a deactivating position, said displacement effected by the pressure differential or the pressure balance in said conduit on the opposite side of said control member arising as a consequence of said body being forced from its aperture-sealing position upon tilting of the housing past a predetermined angle or upon acceleration or retardation of a certain magnitude of said housing.

5 Claims, 3 Drawing Figures

DEVICE TO AUTOMATICALLY ACTIVATE OR DEACTIVATE CONTROL MEANS

BACKGROUND OF THE INVENTION

The subject invention concerns a device designed to effect automatic activation or deactivation of electrically, hydraulically or pneumatically operated control means.

In a number of situations there is a need for devices which are designed to bring about automatic activation or deactivation of control means under certain conditions.

As one example may be mentioned the requirement that cars produced to-day should be equipped with safety belts that lock automatically in position both when the vehicle is tilted above a certain angle of inclination in either direction and when the acceleration or the retardation exceeds a certain value.

SUMMARY OF THE INVENTION

The subject invention provides a device of simple and reliable structure which is designed to effect automatic control of operative means.

The device in accordance with the invention is characterised by a body which is mounted freely in a chamber in an air-tight housing and arranged when in its normal position, to be seated sealingly above an aperture, which aperture, in a first case, is in communication with the ambient atmosphere and, in a second case, is in communication with a conduit connected to either a source of positive pressure or a source of negative pressure, by at least one second conduit in said first case, which second conduit interconnects the chamber and a source of positive pressure or of negative pressure, by at least one third conduit the free end of which is connected to the chamber and the opposite end of which is closed by a control member, said member arranged for displacement in said third conduit against the action of at least one spring means, said free body arranged, upon inclination of the housing past a certain tilting angle to slide, tilt or roll by its own weight from its position wherein its seals off the said aperture, or, upon acceleration or retardation of a certain magnitude of the housing, to be displaced through its inertia from said position, said spring means arranged, upon disappearance of said positive pressure or said negative pressure in said first case or, upon generation of said positive pressure or said negative pressure in said second case, in said chamber and in said third conduit, to bring said control member to affect a process or a means designed to initiate or complete a process.

BRIEF DESCRIPTION OF THE DRAWINGS

The invention will be described in closer detail in the following with reference to two embodiment thereof illustrated in the enclosed drawing wherein.

DETAILED DESCRIPTION OF A PREFERRED EMBODIMENT

Figure 1:
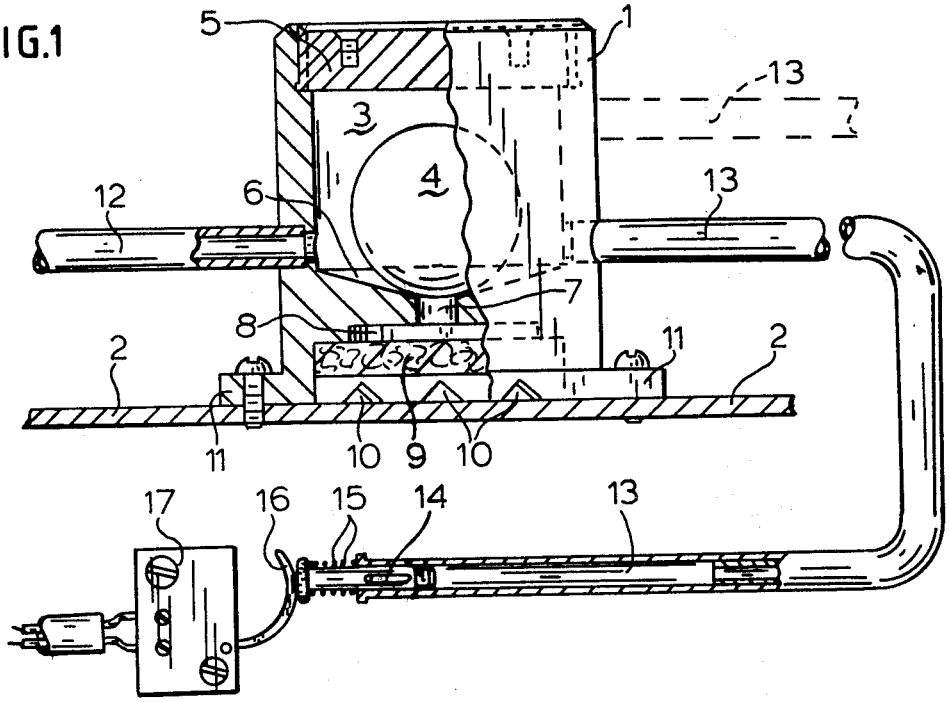
FIG. 1 is a partly broken lateral view of a device in accordance with the first embodiment of the invention in its normal position.
Figure 2:
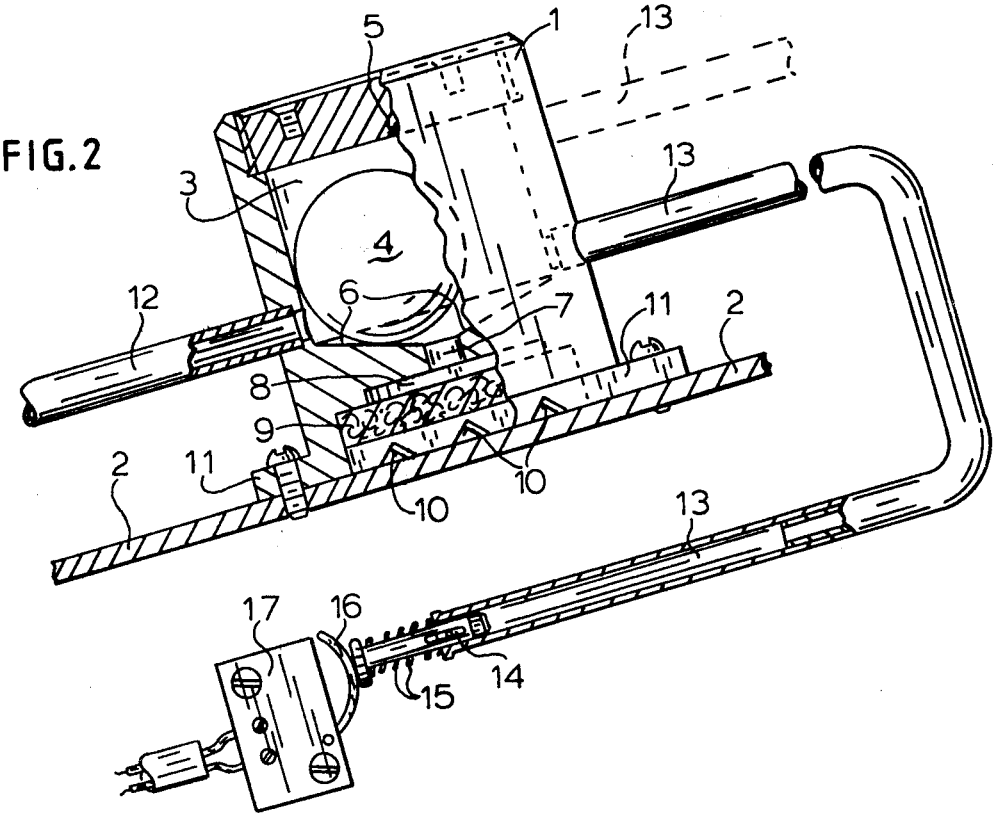
FIG. 2 illustrates the device in accordance with FIG. 1 in a tilted position.

In FIGS. 1 and 2, a housing is generally designated by numeral 1. The housing 1 is secured on a horizontal rail 2 which is imagined to be positioned in a vehicle. In the interior of the housing 1 a chamber 3 is provided in which a body in the shape of a spherical ball 4 is freely mounted. The chamber 3 is closed air-tight at the top by means of a lid 5. The bottom 6 of the chamber 3 is conical or bowl-shaped with a central aperture 7 which communicates with the ambient atmosphere via a larger mouth section 8, a dust filter 9 and channels 10 made in a bottom disc 11. In its normal position, i.e. in the horizontal position, the spherical body 4 rests in abutment against the bottom marginal portion around the aperture 7. A conduit 12 connects the chamber 3 with a source of positive pressure or of negative pressure, not illustrated in the drawings. Additionally, a number of conduits 13 (of which the drawings show one in continuous lines and one in dash-and-dot lines) are connected to the chamber 3 at one of their ends whereas their opposite ends are closed by means of a control member 14. A spring means 15 is mounted thereon and is arranged to press the control member 14 into abutment against a breaker 16 of e.g. an electric switch 17 in a manner to be described in closer detail below.

The mode of operation of the device will be described in detail in the following.

A source of negative pressure, e.g. the suction pipe of the vehicle carburetter, is connected to the chamber 3 to generate a negative pressure therein. In its normal position, the sphere 4 seals tightly against the aperture 7 and the negative pressure is propagated to the conduits 13. In the position indicated in FIG. 1, the control member 14 is somewhat retracted into the conduit 13 against the action of spring means 15 as a consequence of the negative pressure in conduit 13, and abuts against the breaker 16.

FIG. 2 illustrates the device in a tilted or inclining position. As a result of the tilting, the sphere 4 has rolled aside, exposing the aperture 7. When the sphere leaves its position in front of the aperture 7, air is free to flow through the aperture and into the chamber 3, eliminating the negative pressure therein. Air also rapidly penetrates into the conduit 13, with the result that the control member 14 is displaced by the spring tension so as to move the breaker 16 to connecting or disconnecting position. Such connection or disconnection can in turn be utilized to lock e.g. the roll mechanism of a vehicle safety belt.

The inclination causing the sphere to roll from its position closing off the aperture 7 may be varied in different ways. By varying the size of the aperture 7 or the size of the sphere 4, the tilting angle can also be varied.

The tilting angle may be varied by giving the bowl-shaped bottom larger or shallower depths while retaining the same curvature. The sphere is set in motion when the gravitation vector of the sphere intersects the edge of the bowl-shaped bottom.

Furthermore, on account of its inertia, the sphere 4 will be displaced from its sealing position above the aperture 7 as a result of a predetermined rate of a retardation or acceleration. The magnitude of the retardation or acceleration at which the sphere will move from its normal position, can be determined in the same manner as the magnitude of the tilting. When the resultant of acceleration and retardation, respectively, and of the gravity of the sphere intersects the edge of the aperture 7, the sphere moves from its position above the aperture.

Figure 3:
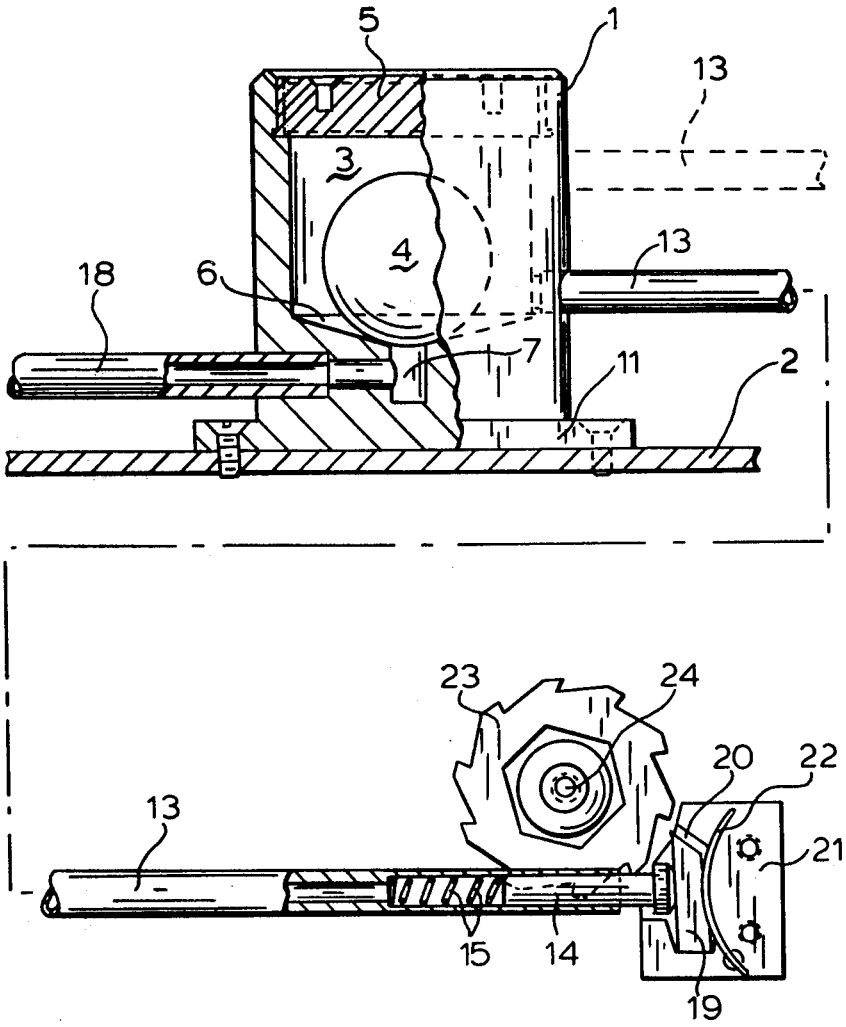
FIG. 3 illustrates in a partly broken lateral view a device in accordance with a somewhat modified embodiment of the invention as compared with FIGS. 1 and 2.

In FIG. 3, the details corresponding to similar details in the embodiment shown in FIGS. 1 and 2, have been given identical reference numbers.

The aperture 7 of the embodiment in accordance with FIG. 3 does not communicate with the ambient atmosphere but with a source of negative pressure (not shown) via a channel 18.

FIG. 3 also indicates a roll mechanism incorporated in a vehicle safety belt.

The roll mechanism comprises a locking element 19 arranged in a cavity 20 in a body 21, and a spring 22 which is arranged to force the locking element to mesh with the teeth of a toothed rim 23. The latter is connected with a reeling drum 24 on which a safety belt may be wound and unwound, respectively.

In the normal position illustrated in FIG. 3, the sphere 4 rests in a sealing position above the aperture 7 and the pressure in the chamber 3, and consequently in the conduit 13, is equal to that of the ambient atmosphere. The control member 14 is biased by the spring 15 and in its normal position it maintains the locking element out of engagement with the toothed rim 23 against the action of the spring 22.

The conduit 18 communicates with a source of negative pressure, e.g. the suction pipe of the carburètter of a car. When the brakes of the car are applied, or when the car assumes a position of inclination at a tilting angle that exceeds a predetermined magnitude, the sphere 4 will roll aside, whereby the negative pressure in the conduit 18 will propagate to the chamber 3 and the conduit 13. As a result, the tension of spring 22 and the atmospheric pressure will displace the control member 14 inwards into the conduit 13, and the locking element 19 consequently will be displaced to its position wherein it meshes with the teeth of the toothed rim 23, thus locking the safety belt in position.

As soon as the sphere 4 rolls back to its sealing position above the aperture 7, e.g. after completed braking of the vehicle, the pressure in the chamber 3 and the conduit 13 gradually return to atmospheric pressure as a result of valve bleeding, e.g. through the conduits 13, whereby the locking element 19 will be forced out of engagement with the teeth by the control member 14.

The invention is not limited to the embodiments described above but a variety of modifications are possible within the scope of the appended claims.

The free-moving body 4 need not be spherical but could have any desired shape as long as it fulfills the essential requirement of being able to seat tightly above the aperture 7 and of being capable of tilting, sliding or rolling from this position when the device is at a predetermined tilting angle or as soon as a predetermined condition of acceleration or retardation exists.

The application of a device in accordance with the invention naturally is not limited to automobiles but a large number of applications are possible. For instance, a device in accordance with the invention could be used in the limbs of industrial robots in order to stop the robot limb movements upon a certain tilting angle by affecting the control member thereof.

In addition, the control member may itself be a flow controlling means.

Positive pressure in the chamber may be used instead of a negative pressure to obtain the same effect. The device need merely be modified by arranging the spring means 15 to counteract the positive pressure in the conduit 13 that affects the control member 14. When the free body 4 then moves from its position above the aperture 7, the positive pressure in the conduit 13 ceases, and the control member is moved by the spring tension to a position wherein it effects connection or disconnection of a breaker means.

What I claim is:

1. A device designed to effect automatic activation or deactivation of electrically, hydraulically, or pneumatically operated control means, comprising:
   - an air-tight housing having a chamber therein;
   - a free-moving body positioned within said chamber with lateral clearance;
   - an aperture within said chamber and positioned at the bottom of said chamber, said aperture in communication with the ambient atmosphere;
   - a first conduit interconnecting said chamber and a source of pressure;
   - a second conduit having one end connected to said chamber and an opposite end closed by a pressure responsive control member, said control member arranged for displacement in said second conduit against the action of at least one spring means, said first and second conduits in permanent communication with said chamber;
   - said free-moving body arranged, in a normal position, to be sealingly seated above said aperture blocking same, but upon inclination of said housing past a certain tilting angle or upon a predetermined magnitude of acceleration or retardation of said housing, to be displaced laterally from its sealing position above said aperture opening same;
   - said spring means arranged, upon movement of said free-moving body from its normal position, to cause said control member to affect a process.

2. An device as claimed in claim 1, wherein the bottom of said chamber in the area around said aperture is bowl-shaped and wherein said free-moving body is in the shape of a spherical ball normally resting on said bottom area in the position sealing said aperture.

3. An device as claimed in claim 1, comprising a dust filter arranged externally of said chamber aperture.

4. A device as claimed in claim 1 wherein said source of pressure is a source of negative pressure.

5. A device as claimed in claim 4 wherein said control member is retracted into said second conduit against the action of said spring means and abuts against a breaker of a switch when said free-moving body is in a normal position, but is displaced when said free-moving body is displaced from its sealing position so as to move the breaker to a different position.

* * * * *